United States Patent [19]

Nanjo et al.

[11] 4,363,473

[45] Dec. 14, 1982

[54] APPARATUS FOR REDUCING IRON ORE OR THE LIKE

[75] Inventors: Toshio Nanjo, Tokyo; Akinori Nakamura, Kamakura; Hidekazu Ishikawa, Iwakuni, all of Japan

[73] Assignee: Ishikawajima-Harima Jukogyo Kabushiki Kaisha, Tokyo, Japan

[21] Appl. No.: 295,571

[22] Filed: Aug. 24, 1981

Related U.S. Application Data

[63] Continuation of Ser. No. 111,107, Jan. 10, 1980, abandoned.

[30] Foreign Application Priority Data

Jan. 19, 1979 [JP] Japan ..... 54-5187

[51] Int. Cl.[3] ..... F27B 1/06

[52] U.S. Cl. ..... 266/187; 75/34; 266/188

[58] Field of Search ..... 266/144, 159, 156, 185, 266/187, 186, 188; 75/34, 35, 91

[56] References Cited

U.S. PATENT DOCUMENTS

| | | | |
|---|---|---|---|
| 3,128,174 | 4/1964 | Celada | 75/34 |
| 3,827,878 | 8/1974 | Wenzel et al. | 75/34 |
| 3,904,397 | 9/1975 | Celada et al. | 75/35 |
| 4,046,556 | 9/1977 | Celada et al. | 75/35 |
| 4,248,623 | 2/1981 | Papst et al. | 75/35 |

*Primary Examiner*—M. J. Andrews

*Attorney, Agent, or Firm*—Alfred E. Miller

[57] ABSTRACT

A reduction process and apparatus wherein the flow of the reducing fluid through the fixed bed of iron ore, oxidized pellet or the like to be reduced is reversed in direction so that the iron ore, oxidized pellet or the like, at any place in the bed, may be reduced uniformly.

4 Claims, 7 Drawing Figures

APPARATUS FOR REDUCING IRON ORE OR THE LIKE

This is a continuation of application Ser. No. 111,107, filed Jan. 10, 1980, now abandoned.

BACKGROUND OF THE INVENTION

The present invention relates to a process and apparatus for reducing iron ore or the like.

In general, in the reduction of oxides, reductants or reducing gases are used. In order to reduce a large amount of oxides within a relatively short time, the oxides are charged into a reactor and the reducing gases are forced to flow through the reactor. This process has the problem that the uniform reduction of the charge cannot be attained as will be described in more detail with reference to FIGS. 1 and 2, showing the prior construction and operation.

Referring to FIG. 1, the lump ore 2 is charged through a top opening 3 of a fixed-bed type reactor 1 and then a top cover 4 is seatled. The reduced product is discharged through a bottom outlet 5 and a discharge or gate valve 6.

The reducing gas is charged through a pipe 7 with a valve 9 into the reactor 1 at the upper portion thereof and the spent gas is discharged from the bottom of the reactor 1 through a pipe 8 with a valve 10.

In operation, after the charge or iron ore 2 has been charged into the reactor 1, the valves 9 and 10 are opened. Then the reducing gas at high temperatures flows through the pipe 7 into the reactor 1 and through the bed of the lump ore 2 from the top A to bottom B and is discharged through the pipe 8. In this process, the charge 2 is reduced.

This process has the problem that the degree of metallization of the lump ore 2 at the top A of the bed is different from the degree of metallization of the lump ore 2 at the bottom B. As shown in the graph of FIG. 2, the degree E of metallization at the top A of the bed is higher than that at the bottom B. This means that the reduction of the lump ore 2 at the bottom B is slower than the reduction of the lump ore at the top A, which is closer to the reducing gas charging port.

It has been reported quantatively that when the degree E of metallization at the top A was 96.3%, the degree of metallization at the bottom B was 73.2%. It has been also reported that while the amount of the reducing gas required for attaining the average degree of metallization of 96% is 1 050 $NM^3$ per ton of the total amount of reduced iron, while the amount for attaining the average degree of metallization of 92.4% is 1 250 $NM^3$. It follows therefore that in order to increase the degree of metallization by 6.4%, the reducing gas must be increased by about 20%. That is, if the flow rate of the reducing gas is constant, the reduction time T would be increased by about 20%.

As described above, the batch of the reduced products varies in degree of metallization. In order to attain the desired qualities, the reduction time T must be increased, but the productivity drops inevitably.

The present invention overcomes the above and other problems encountered in the prior art batch reduction process A and the apparatus and has for its primary object to provide a reduction process and apparatus wherein the flow of the recuding gas or fluid in the charge of oxides to be reduced is reversed so that the oxides or charges both at the top A and bottom B of the bed may be reduced to a uniform degree, whereby the reduced product may have uniform qualities and the reduction time may be reduced. The present invention will become more apparent from the following description of some preferred embodiments thereof taken in conjunction with the accompanying drawings.

DETAILED DESCRIPTION OF THE PREFERRED EMBODIMENTS

Figure 1:
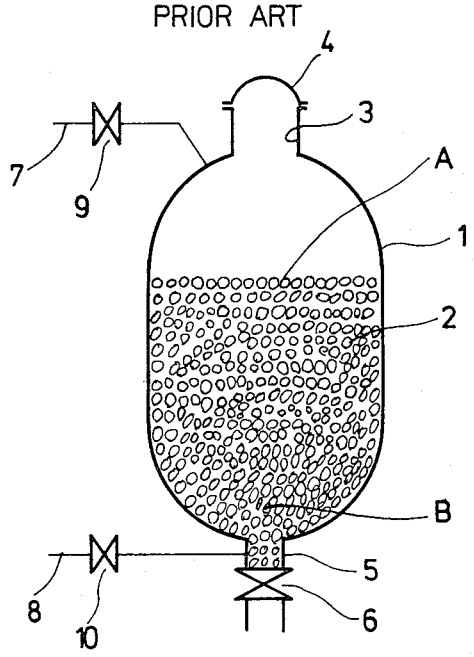
Fig. 1 PRIOR ART
FIG. 1 is a schematic longitudinal sectional view of a reduction reactor of a prior art batch reduction process.
Figure 2:
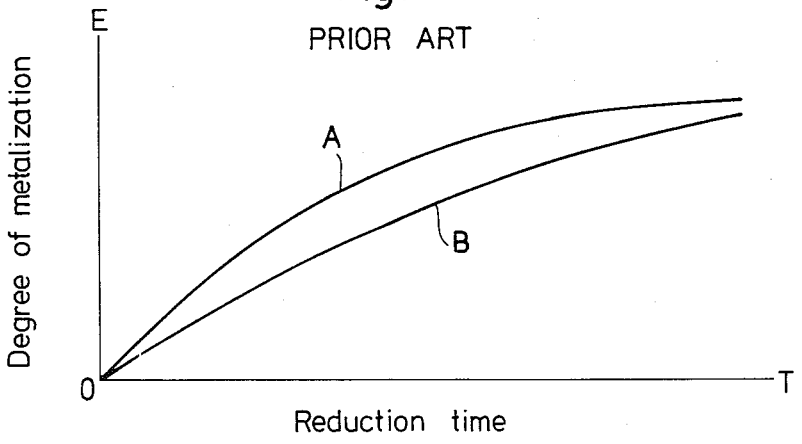
Fig. 2 PRIOR ART
FIG. 2 is a graph showing the relationship between the reduction time T and the degree E of metallization in the batch operation utilized in the reactor shown in FIG. 1.

The same reference numerals refer to similar parts in the figures.

Figure 3:
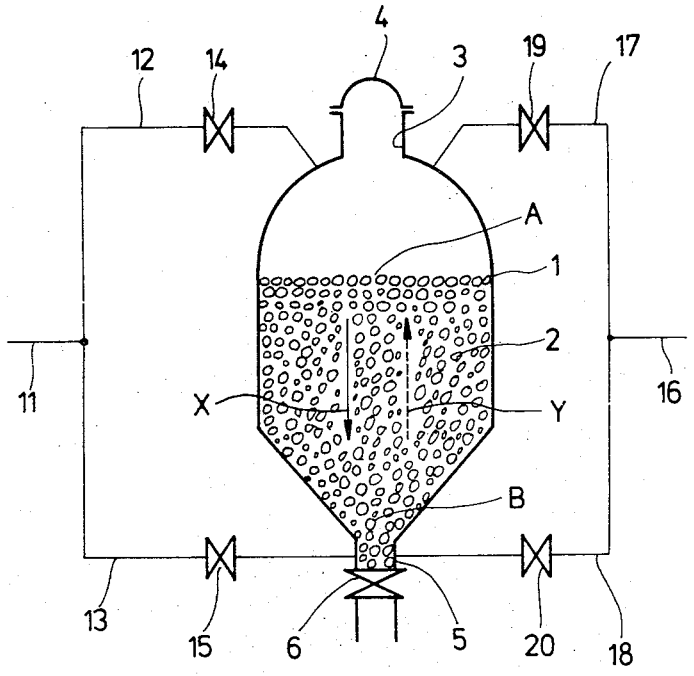
FIG. 3 is a schematic longitudinal sectional view of a first embodiment of a reduction reactor constructed in accordance with the present invention.

Referring to FIG. 3, the lump ore 2 is charged through the feed port or top 3 of the reactor 1 which is closed with the cover 4. The reduced product is discharged through the discharge port 5 having a discharge valve 6 at the bottom of the reactor 1.

The reducing gas supply pipe 11 is is introduced into the system divided into two branches 12 and 13 leading through valves 14 and 15, respectively, to the top and bottom of the reactor 1.

A spent gas discharge pipe 16 is divided into two branches 17 and 18, leading through valves 19 and 20, respectively, to the top and bottom of the reactor 1.

Next, the mode of operation of the first embodiment with the above arrangement will be described. In order to reduce the lump ore 2 charged into the reactor 1, the valves 15 and 19 are closed while the valves 14 and 20 are opened so that the reducing gas flows through the main supply pipe 11, the first branched supply pipe 12, the reactor 1, the second branched discharge pipe 18 and the main spent gas discharge pipe 16. Thus, the reducing gas flows downwards through the bed of the lump ore 2 in the reactor 1 in the direction indicated by the arrow X.

After a predetermined time, the valves 14 and 20 are closed while the valves 15 and 19 are opened. Then the reducing gas flows from the main supply pipe 11 through the second branched supply pipe 13, the reactor 1, the first branched discharge pipe 17 and the main discharge pipe 16. Therefore the reducing gas flows upwards through the bed of the lump ore 2 in the reactor 1 in the direction indicated by the arrow Y. That is, the flow of the reducing gas is reversed in direction.

By reversing of the reducing gas flow, the lump ore 2, both at the top A and bottom B of the bed, may be reduced to a uniform degree of metallization within a relatively short reduction time T. This will be described in detail with reference to FIG. 4. First the lump ore 2 at the top A of the bed are directly exposed to the reducing gas flowing into the reactor 1 and the fresh reducing gas has high temperatures and high reducibility so that the lump ore 2, at the top A of the bed reaches immediately the reduction temperature, at which the reduction starts. After a predetermined time $t_1$, the flow of the reducing gas is reversed in direction as described above. That is, the fresh reducing gas flows into the reactor 1 from the bottom thereof, As a result, the lump ore 2 at the top A of the bed are subjected to the reducing gas at lower temperatures; that is, the reducing gas with less reducibility. As a result, the rate of the reduction at the top A is lowered.

On the other hand, the rate of the reduction of the lump ore 2 at the bottom B of the bed is slow, but when the flow of the reducing gas is reversed at $t_1$ or when the fresh reducing gas flows into the reactor 1 from the bottom thereof, the reduction rate is increased. Therefore the characteristic curves A and B approach to each other and cross after some time after $t_1$. For the sake of comparison, the characteristic curves (dotted lines) are also shown when the flow of the reducing gas is not reversed. It should be noted that when the flow of the reducing gas is not reversed, the degrees of metallization at the top A and bottom B reach the predetermined points $e_4$ and $e_2$, respectively, at time $t_3$, but when the flow of the reducing gas is reversed in direction according to the present invention, the degrees of metallization of the ore at the bottom B and top A reach the predetermined points $e_4$ and $e_2$, respectively, at $t_2$ faster than $t_3$, the difference in absolute value between the degrees $e_4$ and $e_2$ of metallization being equal at both $t_2$ and $t_3$. That is, the reduction time may be reduced by reversing the flow of the reducing gas.

Figure 4:
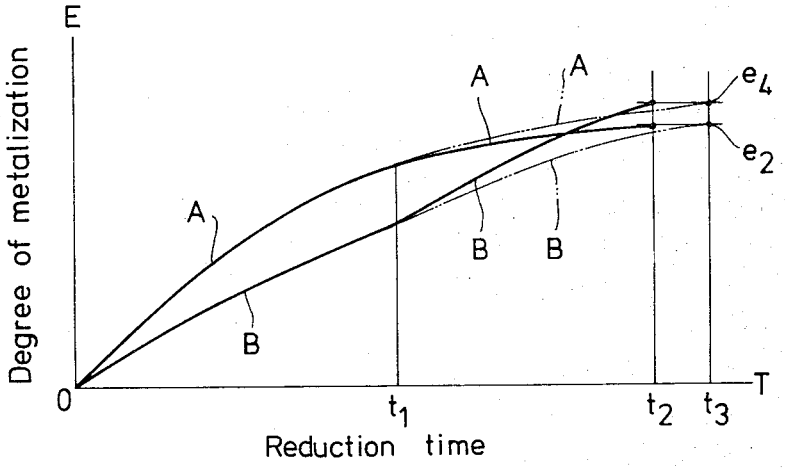
FIG. 4 is a graph showing the relationship between the reduction time T and the degree E of metallization in the batch reduction process when the flow of the reducing gas is reversed once in one batch operation A in accordance with the present invention.
Figure 5:
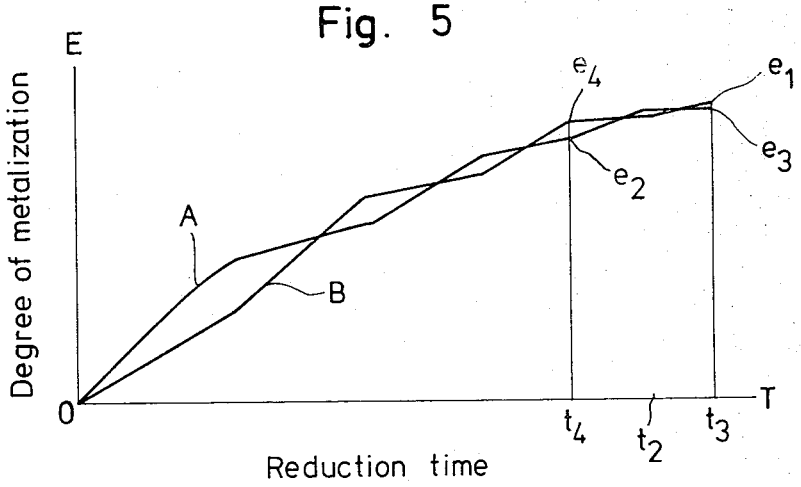
FIG. 5 is a graph showing the relationship similar to that shown in FIG. 4 but with the flow of the reducing gas being reversed many times in one batch operation.

When the flow of the reducing gas is reversed many times in one batch operation, the reduction time may be further reduced to $t_4$ as shown in FIG. 5. That is, at the time $t_4$, the degree of metallization of the lump ore 2 at the top A of the bed reaches $e_2$ while the degree of metallization of the lump ore 2 at the bottom B reaches $e_4$ and the difference in absolute value between them equals that at the time $t_2$ shown in FIG. 4.

Furthermore, when the reduction time is same: that is, $t_3$, the degrees ($e_1$ and $e_3$, See FIG. 5) of metallization of the lump ore attained by the process wherein the flow of the reducing gas is reversed many times in one batch operation are by far higher than those ($e_1$ and $e_2$) attained by the conventional process wherein the flow of the reducing gas is not reversed (See FIG. 4). Moreover, it should be noted that the difference between the degrees $e_1$ and $e_3$ of metallization is by far smaller than that between the degrees $e_4$ and $e_2$. In summary, when the flow of the reducing gas is reversed in direction many times during one batch operation, the degrees of merallization attainable become higher and the difference between them becomes smaller so that the high-quality and uniform reduced producs may be obtained.

Figure 6:
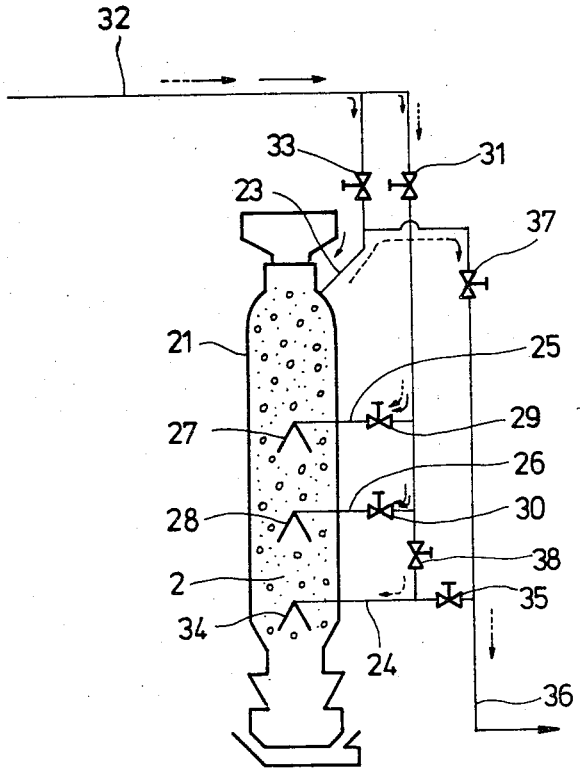
FIG. 6 is a diagrammatic view of a second embodiment of the present invention.

In the second embodiment shown in FIG. 6, the present invention is applied to a shaft furnace 21. The lump ore is charged from the top of the shaft furnace 21 and the reduced product is removed from the bottom thereof as is well known in the art. A plurality (two in FIG. 6) of reductant or reducing gas blowing or blasting pipes 25 and 26 are extended into the shaft furnace 21 and are spaced apart vertically from each other by a suitable distance. The inner end of each of the reducing gas blasting or blowing pipes 25 and 26 is communicated or joined with a nozzle head 27 or 28 consisting of a plurality of radially extended nozzles. The blowing or blasting pipes 25 and 26 are communicated through valves 29 and 30, respectively, and a valve 31 with a main reductant or reducing gas supply pipe 32, which also charges the reductant or reducing gas into the top of the shaft furnace 21 through a pipe 23 with a valve 33.

A spent reductant or reducing gas discharge pipe 24 is extended into the shaft furnace 21 at the lower or bottom portion thereof and is communicated or joined to a nozzle head 34 consisting of a plurality of radially extended nozzles or to any other suitable spent gas collecting means. The discharge pipe 24 is connected through a valve 35 with a main discharge pipe 36. It should be evident that the gas supply nozzles 27 and 28, as well as gas discharge nozzle 34, are aligned parallel to the longitudinal axis of the shaft furnace 21 and centrally therein.

The pipe 23 is also connected through a valve 37 to the main discharge pipe 36 and the blowing or blasting pipes 25 and 26 are also communicated through a valve 38 with the discharge pipe 24.

Next the mode of operation will be described. After the lump ore 2 has been charged into the shaft furnace 21, the valves 29, 30, 31, 33 and 35 are opened while the valves 37 and 38 are closed. Then the reductant or reducing gas flows from the main supply or feed pipe 32 and the blowing or blasting pipes 23, 25 and 26 into the shaft furnace 21 and the spent reductant or reducing gas is discharged through the discharge pipe 24 and the main discharge line 36. Therefore the reducing gas flows from the top to bottom of the shaft furnace 21. In addition to the charging of the reducing gas into the top of the shaft furnace 21 through the pipe 23, the reductant or reducing gas is further blown into the shaft furnace 21 at some levels through the pipes 25 and 26 and their nozzles heads 27 and 28 so that the solids in the shaft furnace 21 may be subjected to uniform reduction, whereby the reduced iron with a uniform degree of metallization may be obtained.

After a predetermined time, the valves 33 and 35 are closed while the valves 37 and 38 are opened so that the flow of the reducing gas in the shaft 21 is reversed in direction. That is, the fresh reducing gas is flown into the shaft furnace 21 through the pipes 25, 26 and 24 and their nozzle heads 27, 28 and 34 while the spent gas is discharged through the pipe 23 and the valve 37 into the discharge line 36. As a result, the reduction of solids at the bottom of the shaft furnace 21 may be facilitated so that more uniform quantity reduced products may be obtained.

As with the first embodiment, during the single batch operation, the flow of the reducing gas may be reversed many times so that the reduced products with more uniform qualities may be obtained in a less time.

So far the present invention has been described in conjunction with the reduction of iron ore, but it is to be understood that the present invention may be equally applied to the reduction of oxidized pellets.

Figure 7:
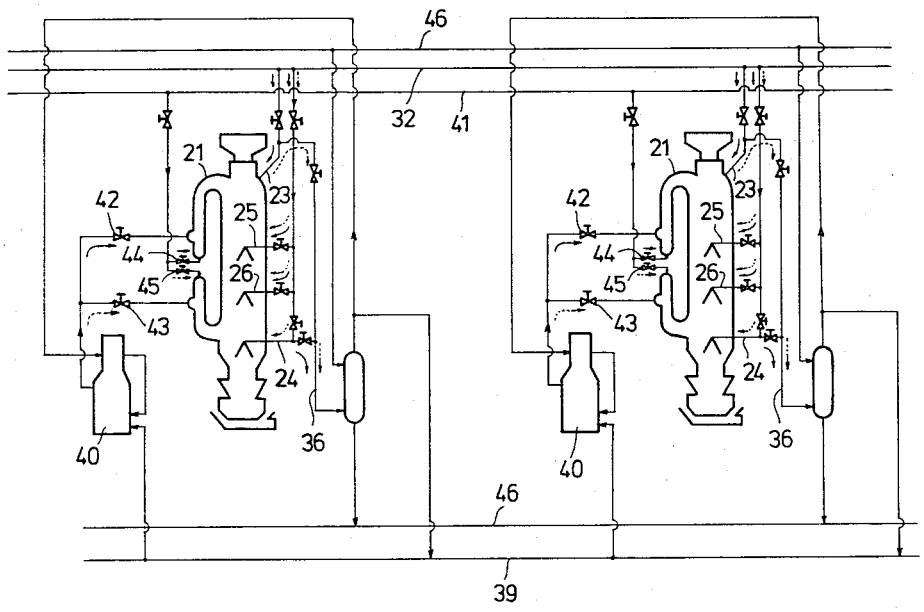
FIG. 7 is a diagrammatic view of a third embodiment of the present invention.

In the third embodiment shown in FIG. 7, a plurality of shaft furnaces 21 may be employed in which only two are shown for purposes of illustration. The arrangement of each shaft furnace 21 is substantially similar to that shown in FIG. 6 except that the addition of a gaseous fuel supply line 39, a pre-heated air line 41, and a cooling water line 46. That is, the gaseous fuel flows from the gaseous fuel supply line 39 through a preheater 40 into the shaft furnace 21 through valves 42 and 43. The pre-heated air is blown from the preheated air supply line 41 through valves 44 and 45. In response to the reversal of the flow of the reducing gas through the shaft furnace 21 in the manner described hereinbefore in conjunction with FIG. 6, the flow of the gaseous fuel and preheated air to the shaft furnace 21 is changed by opening the valves 42 and 44 while closing the valves 43 and 45, and vice versa. The third embodiment may also attain the same effects, features and advantages as those attained by the second embodiment.

The present invention may be summarized as follows:

(1) Oxides such as iron ore and pellets may be subjected uniformly to the reductant such as reducing gas so that the reducibility may be remarkably improved. As a result, the uniform quality reduced products with a higher degree of metallization may be obtained.

(2) The reduction time may be considerably reduced so that a high productivity may be attained.

(3) Operation is simple and apparatus used is very simple in construction. As a result, the present invention may be readily practiced.

What is claimed is:

1. An apparatus for reducing the iron ore or the like wherein at least two pairs of reductant blowing and discharging pipes are communicated with a shaft reactor or the like and are communicated with a reductant supply line and a spent reductant discharge line through valving means adapted to selectively communicate said blowing and discharging pipes with said supply and discharge lines so that the reductant may be blown into said reactor or the like from an upper end thereof through said blowing or discharging pipe toward a lower end of the reactor and may be discharged from said reactor or the like from the lower end thereof through said discharging or blowing pipe, and after a predetermined time interval the reductant may be blowing into said reactor or the like from the lower end thereof and discharged from said reactor or the like from said upper end thereof, whereby the flow of said reductant through said solids in said reactor or the like may be reversed in direction at least one or more times in one batch operation, and each of said reductant blowing and discharge pipes having nozzles located centrally in spaced locations in said shaft reactor and along the longitudinal axis thereof.

2. An apparatus for reducing iron ore or the like comprising a shaft reactor, a reductant supply conduit, a spent reductant discharge conduit, at least two pairs of reductant blowing and discharging pipes communicating with said reactor, and each of said reductant blowing and discharge pipes having nozzles located centrally in spaced locations in said shaft reactor and along the longitudinal axis thereof, said reductant blowing and discharging pipes being in communication with said supply and discharge conduits, valve means for selectively communicating said flowing and discharging pipes with said supply and discharge conduits so that said reductant may be blown in an upper end thereof through one of said blowing and discharge pipes and said reductant is discharged from a lower end of said reactor through another of said blowing and discharge pipes whereby the flow is in one direction, and after a predetermined time interval said reductant may be blown in the lower end of said reactor and discharged from said upper end of said reactor whereby the flow of said reductant through the solids of the iron ore in the shaft reactor is in the opposite direction, said reversal of flow being carried out a plurality of times in a single batch operation.

3. An apparatus as claimed in claim 2 further comprising means for blowing said reductant into said reactor at intermediate levels between said upper end and the lower end of said reactor including two vertically-spaced reductant blowing pipes whereby said solids in the shaft reactor are subject to uniform reduction.

4. An apparatus as claimed in claim 3 further comprising a gaseous fuel supply conduit, and a preheated air conduit each of which is in selective communication with said reactor.

* * * * *